US005360356A

United States Patent [19]

May et al.

[11] Patent Number: 5,360,356

[45] Date of Patent: Nov. 1, 1994

[54] SPRING CONTACT RECEPTACLE

[75] Inventors: Guntram May, Altdorf; Helmut Steinhardt, Nuremberg, Steffen Müller, Nuremberg, Jürgen Hitz, Nuremberg, all of Germany

[73] Assignee: Framatome Connectors Daut & Rietz GmbH & Co. KG, Nuremberg, Germany

[21] Appl. No.: 107,923

[22] Filed: Aug. 17, 1993

[30] Foreign Application Priority Data

Aug. 18, 1992 [DE] Germany ..... 4227287

[51] Int. Cl.[5] ..... H01R 4/48

[52] U.S. Cl. ..... 439/839; 439/851

[58] Field of Search ..... 439/842, 843, 851–857, 439/861, 862, 839, 833

[56] References Cited

U.S. PATENT DOCUMENTS

| | | | |
|---|---|---|---|
| 4,453,799 | 6/1984 | Inoue . | |
| 4,583,812 | 4/1986 | Gross, Jr. et al. | 439/839 |
| 4,834,681 | 5/1989 | Chaillot . | |
| 4,932,877 | 6/1990 | Zinn | 439/839 |
| 5,007,865 | 4/1991 | Jakobeit | 439/839 |
| 5,035,661 | 7/1991 | Steinhardt et al. | 439/839 |
| 5,240,439 | 8/1993 | Egenolf | 439/745 |

FOREIGN PATENT DOCUMENTS 9106775 8/1991 Germany .

*Primary Examiner*—David L. Pirlot
*Attorney, Agent, or Firm*—Collard & Roe

[57] ABSTRACT

An electrical spring contact having an inner spring contact with an inner spring base and inner spring arms. A box-shaped outer spring with an outer spring base and outer spring arms is connected to the inner spring base of the inner spring. The outer spring arms are bent inwardly in a funnel-shaped way at the plug-in end, and the inner spring and the outer spring are formed by molded sheet metal parts. The outer spring has a bending slot extending across its total length, and the spring contact is insertable in a chamber of a receiving casing and arrestable in the latter by holding members. The lateral surfaces of the outer spring extending between the two outer spring arms are provided with recesses bordered by support surfaces. The support surfaces are axially supported by holding members projecting into the chamber of a receiving case.

16 Claims, 4 Drawing Sheets

SPRING CONTACT RECEPTACLE

BACKGROUND OF THE INVENTION

1. Field Of the Invention

The present invention relates to an electrical spring contact with an inner spring consisting of an inner spring base and inner spring arms. A box-shaped overspring is attached to the inner spring base. The overspring is bent inwardly in a funnel-shaped form at the plug-in end. The inner spring and the overspring are formed by molded sheet metal parts, whereby the overspring has a bending slot extending across its total length. The spring contact is insertable in a receiving case and retained therein by holding members.

2. The Prior Art

A known contact spring (German Patent No. 9,106,775) has an inner spring and an overspring in the shape of a box. The contact spring is located in a receiving case and attached thereto by means of spaced arresting lances arranged near the plug-in end of the overspring and projecting beyond the outer contour of the spring contact. The arresting lances, when assuming their spread positions, support themselves in undercuts or perforations of the receiving case. Aside from the fact that the arresting lances are complicated in design, attachment of the spring contact by means of arresting lances is unstable and unsafe mechanically, as well. Furthermore, the arresting lances must be bent back to dismantle the spring contact, which is difficult.

Finally, the arresting lances require an increased size of the contact, which prevents miniaturization of the spring contacts.

SUMMARY OF THE INVENTION

It is, therefore, an object of the present invention to provide a spring contact that is simply designed and is suitable for safe and stable attachment in the receiving case.

Furthermore, it is an object of the present invention to provide a spring contact that can be readily disassembled without damage.

These and other related objects are achieved according to the invention by providing a spring contact receptacle where the lateral surfaces of the overspring extend between the two overspring arms and have constrictions or recesses in the axial edge zones across part of their lengths. A bending slot is located in one of the lateral surfaces. The bending slot permits the overspring sections extending parallel with the overspring arms to be compressed or pivoted toward each other. The limiting surfaces of the recesses close to the free end are axially supported on attachments projecting into the chamber of the receiving case.

The spring contact, in addition to the contact force-increasing effect due to its box-shaped design, has a protective function for the contact spring arms, and is biased to be securely disposed within the receiving case. Furthermore, the selected support permits a reduction in size of the contact spacing, which facilitates miniaturization of the spring contacts. Moreover, the pivotal feature of the overspring sections permits simplified and damage-free installation and removal of the spring contact. The sturdy construction of the spring contact permits the application of greater dismantling forces. Finally, the design of the spring contact allows for lower tool costs and prolongation of the life of the tools.

Sufficient flexibility of the overspring sections for installation and removal is achieved by a wedge-shaped bending slot with an increasingly greater width toward the free end of the overspring. The overspring sections can be made flexibly in a variety of other ways. For example, the bending slots can be designated with substantially the same width across its entire length, with the edges of the bending slot being slightly tapered or sloped.

For reducing the force needed to compress the overspring sections, the lateral surface disposed opposite the lateral surface with the bending slot is provided with a further slot extending at least across a partial length from the free end toward the outer spring base. The further slot is bordered by tapered surfaces that are parallel to each other or V-shaped.

In a further development of the spring contact, provision is made to support the limiting surfaces of the recesses, that are close to the free end, on attachments, projections or similar holding members that project into the chamber and are rigidly connected with the case. The holding members extend partially across or across the total width of the chamber. The holding members may also be formed in the center of the chamber, or laterally displaced in the chamber.

For the easy and safe plugging of the spring contact into the receiving casing, the holding members are provided with inclined surfaces. As the spring contact is pushed into the case, the outer spring arms move together as they move up the inclined surfaces. Once the outer spring arms pass the holding members, they will snap open with the holding members entering the recesses.

The lateral surfaces or the outer spring arms are prestressed outwardly to provide a retaining force against the walls of the chamber. This provides a permanent prestress between the spring contact and the walls of the chamber. The prestress advantageously holds the spring contact in the receiving casing in a vibration-damping manner, which reduces the frictional wear.

Finally, provision is made to overgrip or overlay the overspring in the chamber by support bodies rigidly connected to the receiving case. The support bodies and holding members axially position and retain the spring contact in the chamber of the receiving case. In addition, a locking body is flexibly mounted on the case and bendable into recesses of the spring contact. The locking body can be engaged from behind and locked by a locking member that is slidable into the receiving case. In this way, the spring contact is fixable both in receiving cases with support members and in receiving cases with locking bodies that are arrestable by locking members.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
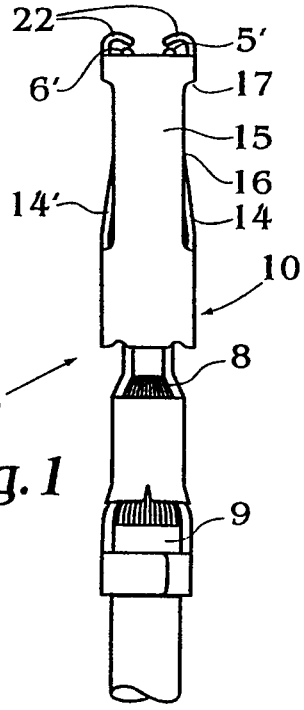
FIG. 1 is a left side elevational view of a first embodiment of a spring contact according to the invention.

Referring now in detail to the drawings, and in particular to FIGS. 1–3, 14 and 16, there is shown a spring contact 1, including an inner spring 2 with a U-shaped base 3 and contact spring arms 5 and 6 arranged on the legs 4 of base 3. Contact spring arms 5 and 6 extend inclined relative to each other toward the free end of the contact spring 1 and, on the free end, have sections 5′ and 6′, which are bent back outwardly to form run-in bevels. A crimp attachment 7 is connected with base 3 of inner spring 2 for connecting to an electrical conductor 8 and its insulation 9. Inner spring 2 is manufactured from flat sheet metal, for example.

An overspring 10, having a box shape, for example, is attached to inner spring 2. Overspring 10 includes a base 11 that is pushed onto base 3 of inner spring 2 and attached by inwardly bent tabs 12, which engage recesses 13 of spring base 3. Overspring arms 14, 14′ are formed on base 11 and extend substantially parallel with contact spring arms 5, 6 and rest against contact spring arms 5, 6 to increase their contact pressure. Overspring 10 is manufactured from flat sheet metal, for example. Lateral surfaces 15 include recesses 16 that extend across overspring 14. Support surfaces 17 define the upper end of recesses 16 close to the free end of spring contact 1. Directly above support surfaces 17 are guide elements 22 that are bent inwardly toward each other over sections 5′ and 6′ of inner spring 2.

Figure 8:
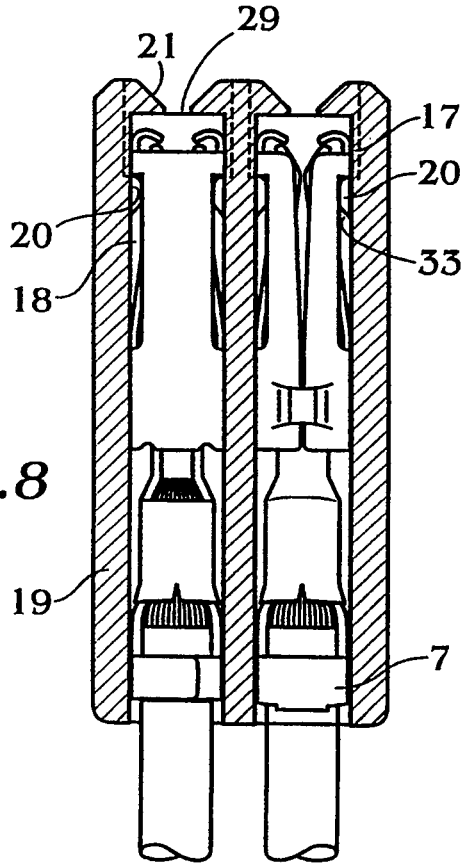
FIG. 8 is a side elevational view of two spring contacts from FIG. 1 in a receiving case.
Figure 16:
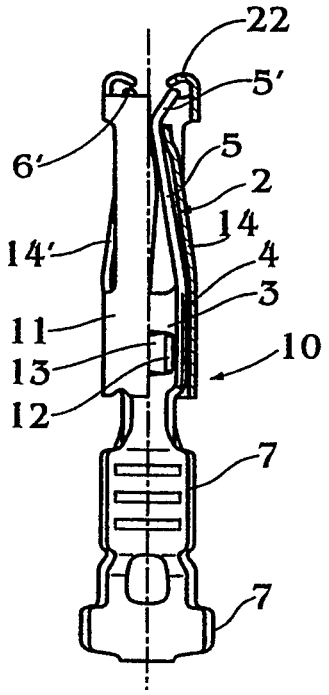
FIG. 16 is a left side elevational view in part cross section of a spring contact.
Figure 13:
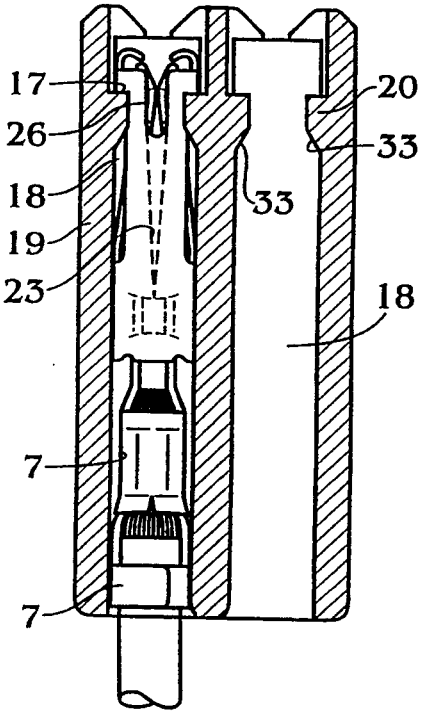
FIG. 13 is a left side elevational view of a spring contact according to FIG. 9 in a further embodiment of the case.

As can be seen in FIGS. 8 and 13, spring contact 1 is inserted into a chamber 18 of a receiving case 19. Support surfaces 17 rest on attachments 20 that project into chamber 18 and are fixed in the axial direction. Furthermore, in FIGS. 8 and 13, attachments 21 partly overgrip the chamber at the plug-in end and limit the width of plug-in slots 29 that receive a knife-blade contact (not shown). Spring contact 1 is prevented from unintentionally sliding out of chamber 18 by attachments 21. At the free end, inwardly bent guide elements 22 provide a V-shaped guide for the knife-blade contacts (FIG. 16).

Figure 2:
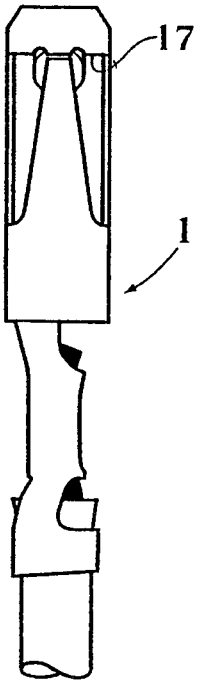
FIG. 2 is a front side elevational view thereof.
Figure 3:
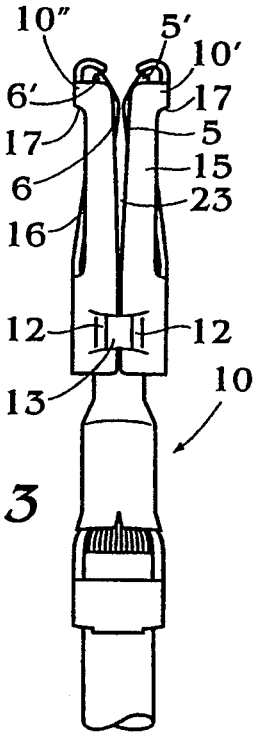
FIG. 3 is a right side elevational view thereof.
Figure 14:
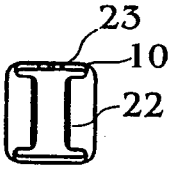
FIG. 14 is a top plan view of a spring contact according to FIG. 1.

In the exemplified embodiment of the spring contact according to FIGS. 1–3, a bending slot 23 is formed in a lateral surface 15 that has an increasingly greater width toward the free end of overspring 10. Bending slot 23 permits overspring sections 10′ and 10″, that are on either side of bending slot 23, to be moved toward each other. Spring contact 1 is inserted in the bottom of chamber 18 of receiving case 19 and pushed upward so that overspring sections 10′, 10″ contact inclined surfaces 33 of the attachments 20. Overspring sections 10′, 10″ are pressed together by inclined surfaces 33 and spring back open once past attachment 20. Support surfaces 17 engage attachments 20 to hold spring contact 1 in place. The overspring sections 10′, 10″ are unlockable with an unlocking tool (not shown) that is inserted through the plug-in slots 29, so that spring contact 1 can be removed from chamber 18 without any damage.

Figure 4:
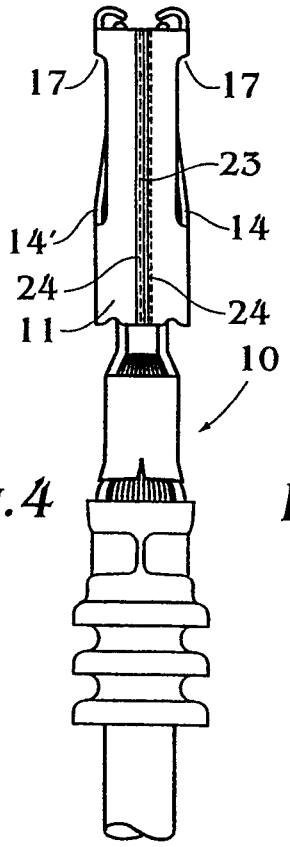
FIG. 4 is a left side elevational view of a second embodiment of a spring contact according to the invention.
Figure 5:
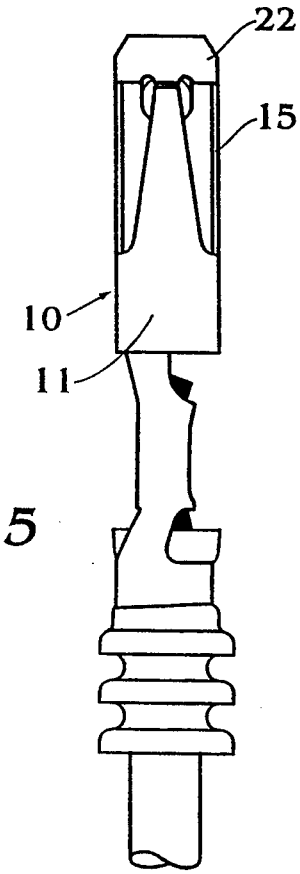
FIG. 5 is a front side elevational view thereof.
Figure 7:
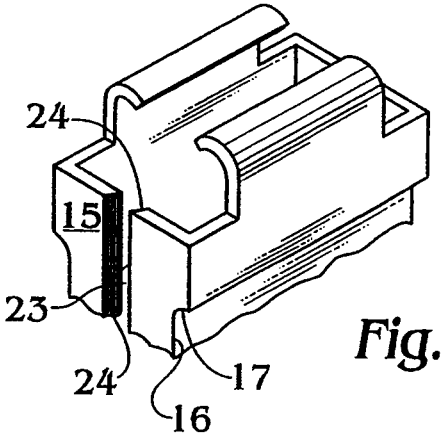
FIG. 7 is an enlarged perspective view of a box-shaped overspring from FIG. 4.

In the exemplified embodiment of the spring contact according to FIGS. 4, 5 and 7, bending slot 23 is bordered by parallel surfaces 24. Surfaces 24 are inclined or chamfered with respect to each other. As spring contact 1 is inserted into chamber 18, surfaces 24 slide past one another, so that spring contact 1 can be compressed beyond the contact point of surfaces 24, i.e., surfaces 24 overlap.

Figure 9:
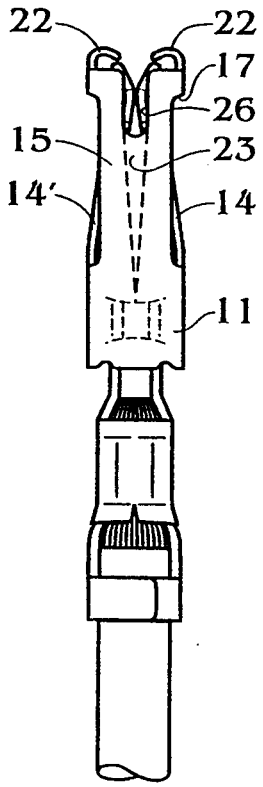
FIG. 9 is a left side elevational view of a third embodiment of a spring contact.
Figure 10:
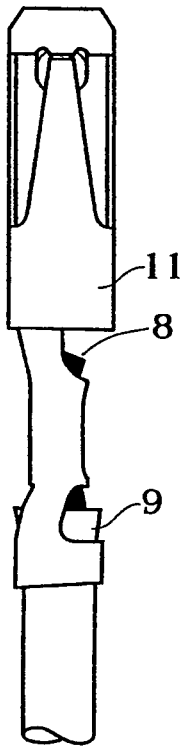
FIG. 10 is a front side elevational view thereof.
Figure 11:
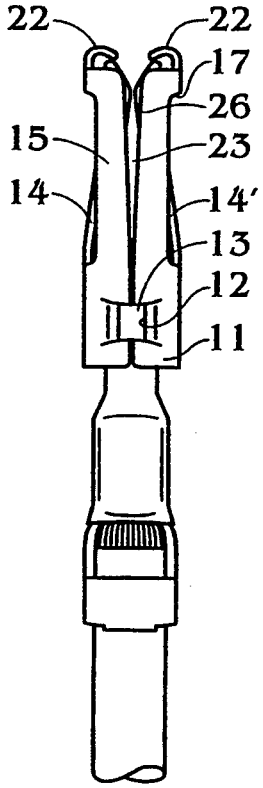
FIG. 11 is a right side elevational view thereof.
Figure 15:
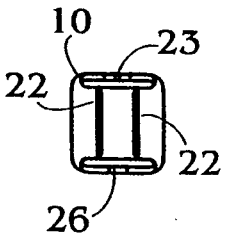
FIG. 15 is a top plan view of a spring contact according to FIG. 4.

In the exemplified embodiment according to FIGS. 9, 10, 11, 13 and 15, spring contact 1 is provided with a slot 26 in lateral surface 15. Slot 26 is disposed opposite wedge-shaped bending slot 23. Slot 26 extends partially along the length of lateral surface 15 and aids in the compression of overspring sections 10′, 10″. Slot 26 can be designed in any way, for example, as shown in FIGS. 9 and 13, or triangular-shaped or trapezoidal.

Figure 6:
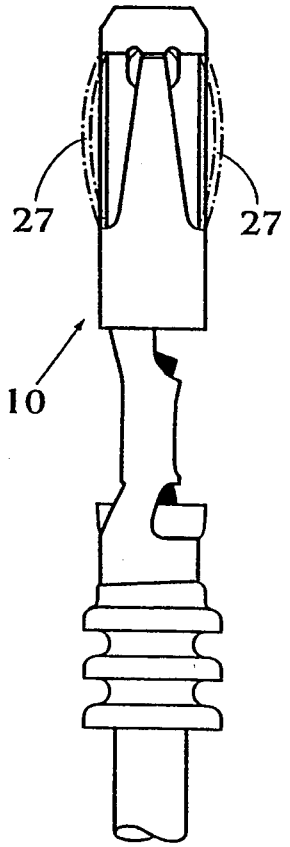
FIG. 6 is a front side elevational view similar to FIG. 2, with outwardly bent lateral surfaces.

While in FIGS. 1 and 3, lateral surfaces 15 of overspring 10 are designed as plane surfaces, FIG. 6 shows a spring contact 1 whose lateral surfaces 15 (shown by the dash-dotted lines 27) of the overspring 10 are bent outwardly. When spring contact 1 is introduced in chamber 18 of receiving case 19 according to FIG. 8, the outwardly bent lateral surfaces 27 exert a frictional force against the walls of chamber 18. This force fit assures vibration-free mounting of spring contact 1 in chamber 18.

Figure 12:
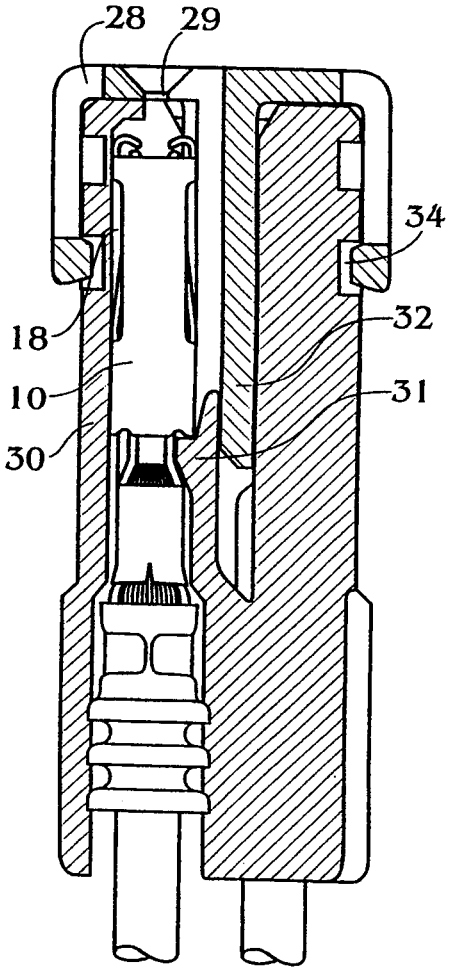
FIG. 12 is a left side elevational view of a spring contact according to FIG. 1 in an alternate embodiment of the case.

In the exemplified embodiment according to FIG. 12, chamber 18 of receiving case 30 is overgripped or overlaid at its free end by a lid part 28 that can be snapped on at a recess 34. Lid part 28 has an insertion opening 29 for a knife-blade contact (not shown). Furthermore, receiving case 30 has a locking body 31 engaging the bottom edge of overspring 10. Locking body 31 is supported in the arrested position shown by a locking member 32 coupled to lid part 28. Spring contact 1 is inserted in chamber 18, while lid part 28 is removed from case 30. Locking body 31 swings outwardly as overspring 10 pushes against it and automatically returns to the locked position, as shown. Lid 28 is then attached to bring locking member 32 into engagement with locking body 31.

It is understood that the spring contact thus can be selectively used in receiving case 19 with attachments 20 projecting into the chamber (FIGS. 8 and 13) or in receiving case 30 (FIG. 13) with locking bodies 31.

While several embodiments of the present invention have been shown and described, it is to be understood that many changes and modifications may be made thereunto without departing from the spirit and scope of the invention as defined in the appended claims.

What is claimed is:

1. A spring contact receptacle locatable in a chamber of a receiving case and being retained therein by holding members, the spring contact receptacle comprising:

a sheet metal inner spring contact including an inner spring base and inner spring arms having free ends;

a sheet metal outer spring, including an outer spring base, two spaced outer spring arms, and two lateral surfaces extending between said outer spring arms, said outer spring being box-shaped and connected to said inner spring base, with said outer spring arms bent inwardly over said free ends of said inner spring arms to form a V-shaped guide, said outer spring having a bending slot across its entire length formed within one of said lateral surfaces to allow said outer spring to be compressed for insertion and removal from the receiving case; and said lateral surfaces including recesses across part of their lengths and support surfaces defining edges of the recesses closest to said free ends, said support surfaces extending transversely to said free ends and said support surfaces being axially supported on the holding members of the receiving case.

2. The spring contact receptacle according to claim 1, wherein the bending slot is V-shaped with the open end of the V facing said free ends.

3. The spring contact receptacle according to claim 1, wherein said outer spring includes substantially parallel, tapered edges defining opposite sides of the recess, wherein said tapered edges slide past each other during compression of said outer spring.

4. The spring contact receptacle according to claim 1, wherein said outer spring has a width greater than an inside width of the receiving case.

5. The spring contact receptacle according to claim 1, further comprising a receiving case including holding members and support members that cooperatively, axially retain the spring contact within said receiving case.

6. The spring contact receptacle according to claim 1, further comprising a receiving case including a flexibly-mounted locking body and a locking member, wherein said locking body releasably engages at least one of said inner spring and said outer spring and is held in the engaged position by said locking member.

7. The spring contact receptacle according to claim 1, wherein the lateral surface opposite the one lateral surface with the recess includes a slot extending at least along part of the length of the other lateral surface beginning at said free ends and extending toward said outer spring base.

8. The spring contact receptacle according to claim 7, wherein the other lateral surface includes 9. The spring contact receptacle according to claim 7 wherein said lateral surfaces are substantially parallel to each other.

10. The spring contact receptacle according to claim 7, wherein at least one of said lateral surfaces extends outwardly away from said inner spring and is biased against said receiving case.

11. The spring contact receptacle according to claim 7, wherein the slot is V-shaped with the open end of the V facing said free ends.

12. The spring contact receptacle according to claim 11, wherein the other lateral surface includes tapered edges defining opposite sides of the slot. substantially parallel tapered edges defining opposite sides of the slot.

13. The spring contact receptacle according to claim 1, further comprising a receiving case with holding members, said holding members extending at least partially across the width of said receiving case, wherein said outer spring arms compress together for axial movement past said holding members.

14. The spring contact receptacle according to claim 13, wherein said holding members are centered along the width of said receiving case.

15. The spring contact receptacle according to claim 13, wherein said holding members are disposed laterally within said receiving case.

16. The spring contact receptacle according to claim 13, wherein said holding members include inclined surfaces extending from said receiving case to said holding members in the axial direction toward said free ends, wherein said inclined surfaces contact and compress said outer spring arms as said outer spring is axially inserted into said receiving case toward said free ends.

* * * * *